United States Patent [19]

Focke

[11] 4,258,525

[45] Mar. 31, 1981

[54] METHOD AND APPARATUS FOR WRAPPING GROUPS OF CIGARETTES

[75] Inventor: Heinz Focke, Verden, Fed. Rep. of Germany

[73] Assignee: Focke & Co., Verden, Fed. Rep. of Germany

[21] Appl. No.: 6,306

[22] Filed: Jan. 24, 1979

Related U.S. Application Data

[62] Division of Ser. No. 816,069, Jul. 15, 1977, Pat. No. 4,161,093.

[30] Foreign Application Priority Data

Jul. 22, 1976 [DE] Fed. Rep. of Germany ..... 2632967

[51] Int. Cl.[3] ..... B65B 11/08

[52] U.S. Cl. ..... 53/228

[58] Field of Search ..... 53/228, 229, 230, 389; 271/184, 185, 194, 195; 198/486

[56] References Cited

U.S. PATENT DOCUMENTS

| | | | |
|---|---|---|---|
| 2,902,082 | 9/1959 | Watson | 198/486 X |
| 3,085,501 | 4/1963 | Wimmer | 198/486 X |
| 3,385,026 | 5/1968 | Schmermond | 53/389 |
| 3,494,482 | 2/1970 | Lense | 198/486 X |
| 3,779,546 | 12/1973 | Wujtowicz et al. | 271/184 |
| 3,860,125 | 1/1975 | Johnson et al. | 198/486 X |
| 4,161,093 | 7/1979 | Focke | 53/228 |

*Primary Examiner*—John Sipos

*Attorney, Agent, or Firm*—Sughrue, Rothwell, Mion, Zinn and Macpeak

[57] ABSTRACT

Apparatus for wrapping a stack of cigarette packs in a carton blank includes means for severing a blank from a supply web fed to the apparatus in a direction transverse to the longitudinal axis of the stack, vacuum suction means for holding the severed blank and rotating it until its longitudinal axis is aligned with that of the stack, and slider means for pushing the stack off of its feed conveyor, against the blank, and into the opening of a mouthpiece, whereby the blank is U-wrapped around the stack.

7 Claims, 5 Drawing Figures

METHOD AND APPARATUS FOR WRAPPING GROUPS OF CIGARETTES

This is a division of application Ser. No. 816,069, filed July 15, 1977 now U.S. Pat. No. 4,161,093.

BACKGROUND OF THE INVENTION

1. Field of the Invention

The present invention relates to a process and apparatus for wrapping oblong articles, more particularly, packs stacked on top of or adjacent to one another, in a blank which is separated from a web in such a way that its longitudinal extension is directed at right angles to the longitudinal extension of the article.

2. Description of the Prior Art

The invention relates essentially to the individual features of a bundle packer. With these machines, groups of packs, for example, a large number of cigarette packs disposed on top of one another and adjacent to one another in a double row, are wrapped in a common blank.

SUMMARY OF THE INVENTION

In the case of the invention, the blank is, for a given reason, namely its special shape, arranged with its longitudinal axis at right angles to the longitudinal axis of the article, resp., of the group of packs, after its separation from a web of packaging material. Accordingly, the object of the present invention is to provide a process and apparatus by means of which oblong articles or oblong groups of packs can be wrapped in a blank arranged in the abovedescribed manner or relative position.

The process according to the invention which is designed to solve this problem is characterized in that the separated blank is arranged in the same direction as the article by rotating the blank in its own plane. This rotation of the blank about its own axis disposed at right angles to the plane of the blank can take place directly in the region where the blank is separated from the web or can be associated with a feed movement of the blank. Rotation of the blank also takes place generally in the plane of the feed web, resp., in a plane parallel thereto.

An apparatus for effecting this process is equipped with a blank holder which engages the separated blank and, while rotating the same, supplies it to the group of packs. This blank holder, which is equipped with suction holders for gripping the spread-out blank can be in the form of a rotary disk rotating about its own transverse axis or can be mounted on a pivotable or rotating conveyor.

Other features of the invention relate to the structure and arrangement of the suction holder.

Other objects, features and advantages of the present invention will be made apparent in the course of the following detailed description of preferred embodiments thereof provided with reference to the accompanying drawings.

DESCRIPTION OF THE PREFERRED EMBODIMENTS

Figure 2:
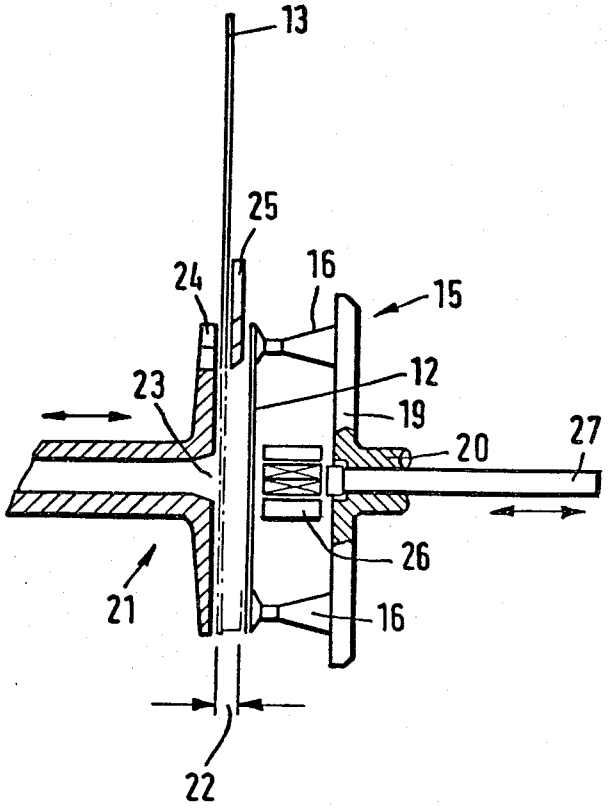
FIG. 2 is a median, vertical sectional view along the line II—II of the apparatus shown in FIG. 1.

The embodiments represented relate to the packaging of groups of packs 10 consisting, for example, of cigarette packs 11. These are stacked flat on top of one another and adjacent to one another in a double row. Each such group of packs 10 is to be wrapped in a blank 12 of appropriate dimensions.

The blank 12 is separated from a web 13 of packaging material, for example, paper. In the present case, a special feature consists in that the edges 14 of the blank 12 which were produced by the parting cut and which extend at right angles to the feed direction of the web 13 are irregular and correspond to the design of the wrapping to be produced. The projections and recesses formed by this irregular edge 14 form end or closing flaps which project beyond or are to be folded against the end faces. In order to make maximum use of the surface area of the web 13, the above end or closing flaps forming the edge 14 are in toothed engagement with one another. As a consequence, after separation from the web 13, the "longitudinal" axis of the blank 12 is no longer disposed in the same direction as the "longitudinal" axis of the group of packs 10. The group of packs 10 is preferably formed and supplied in such a way that oblong structures with horizontal "longitudinal" axes are produced whereas the "longitudinal" axis of the blank, after it has been separated from the web 13, is vertically disposed in the same way as the "longitudinal" axis of the web 13.

After separation the blank 12 is rotated in its plane and supplied to the group of packs 10 in such a way that the group of packs 10 can be pushed through the plane of the blank carrying with it the blank 12 arranged in a U-shaped manner. Further conventional folding steps are then carried out.

The blank 12 separated from the web is gripped by a blank holder 15 and rotated thereby and, if necessary, advanced. The blank holder 15 is equipped on its side facing towards the blank 12 with holding elements, namely suction holders 16 for gripping the spreadout blank 12. As is particularly apparent from FIGS. 3 and 5, the suction holders 16 are supplied by way of suction channels 17 which, in these embodiments, are connected to a stationary channel section 18. The channels 17 and thus the suction holders 16 which they supply are connected to a suitable vacuum source solely in the region of this channel section 18.

Figure 1:
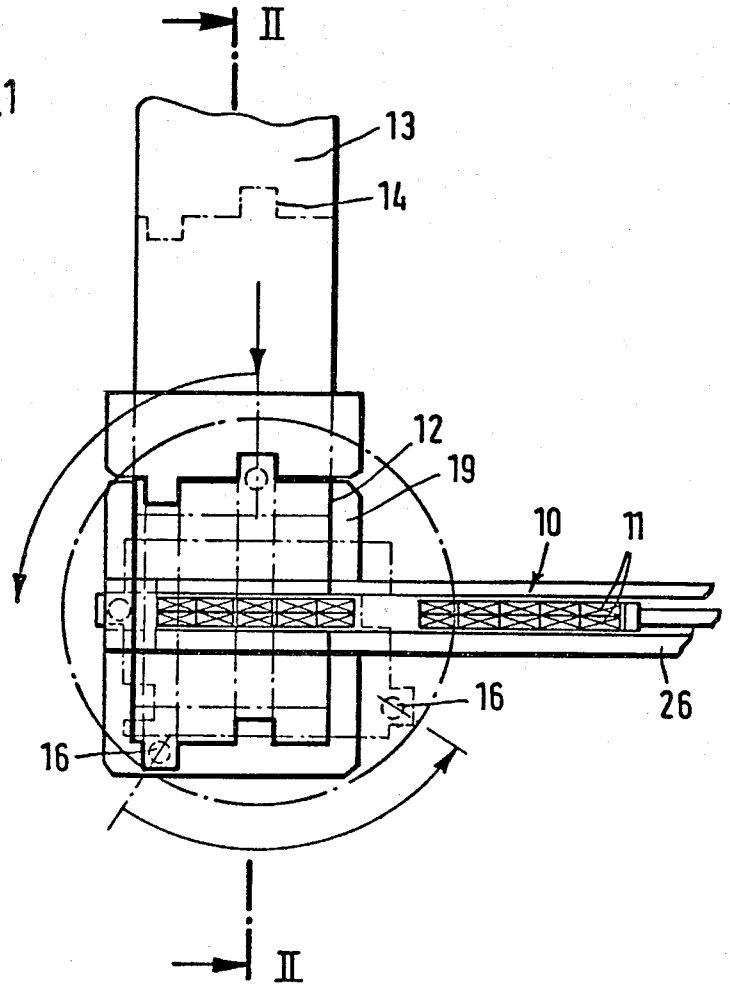
FIG. 1 is a considerably simplified side view of an embodiment of the apparatus.

In the embodiment shown in FIGS. 1 and 2, the suction holder 16 is in the form of a rotary disk 19. This disk 19 is adapted to be driven in rotation via a hollow shaft 20 via a gear which is not shown in detail. A mouthpiece is mounted for reciprocating displacement in an axial direction opposite the rotary disk 19. The displacement zone 22 is shown in FIG. 2. The web 13 is supplied in a plane directly upstream of the mouthpiece 21. The mouthpiece 21 is provided with an opening 23 in which the group of packs 10 and the blank 12 are inserted.

As soon as the blank 12 reaches the position represented by the perforated lines in FIG. 2, the mouthpiece 21 is moved from the starting position indicated in the direction of the rotary disk 19 about the displacement zone 22. As a result, the blank 12 is separated from the web 13. In the embodiment represented, the upper edge of the mouthpiece 21 is in the form of a movable cutting blade 24. A stationary counter blade 25 is disposed on the opposite side of the web 13. The cutting edges of the blades 24 and 25 are designed according to the edge 14 of the blank 12 to be cut.

As a result of the feed movement of the mouthpiece 21, the web 13 is pressed against the counter blade 25 in the region of the cutting blade 24 and the blank 12 is then cut. Immediately adjacent to this cutting position is the rotary disk 19, the suction holders 16 of which directly take up the blank 12 which is separated and supplied by the mouthpiece 21.

The blank 12 is then rotated in its plane by corresponding rotation of the rotary disk 19. In this case it is rotated about 90°. As a result, the blank 12 is now arranged in the same direction as the group of packs 10.

The group of packs 10 is held ready opposite the opening 23 of the mouthpiece 21 on a suitable conveyor 26. In the present case this is disposed between the rotaty disk 19 and the mouthpiece 21 on the side of the blank facing towards the rotary disk 19. Accordingly, the suction holders 16 are of suitable length. By rotating the rotary disk 19, the blank 12 is disposed in the correct position for insertion with the group of packs 10 in the opening 23 of the mouthpiece 21. This first folding step is effected by a slider 27. The slider is mounted in the hollow shaft 20 for displacement in a reciprocating movement. As a result of a feed movement of the slider 27, the group of packs 10 is movable away from the conveyor 26, carrying with it the blank 12, and is inserted in the mouthpiece 21.

Figure 4:
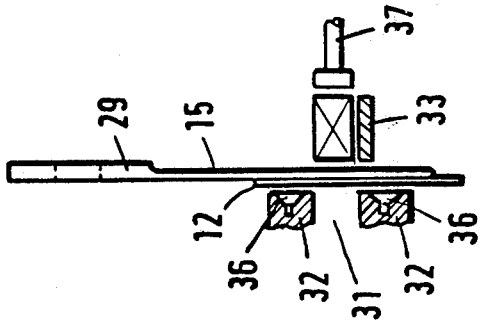
FIG. 4 is a section along the line IV—IV of the apparatus shown in FIG. 3.
Figure 3:
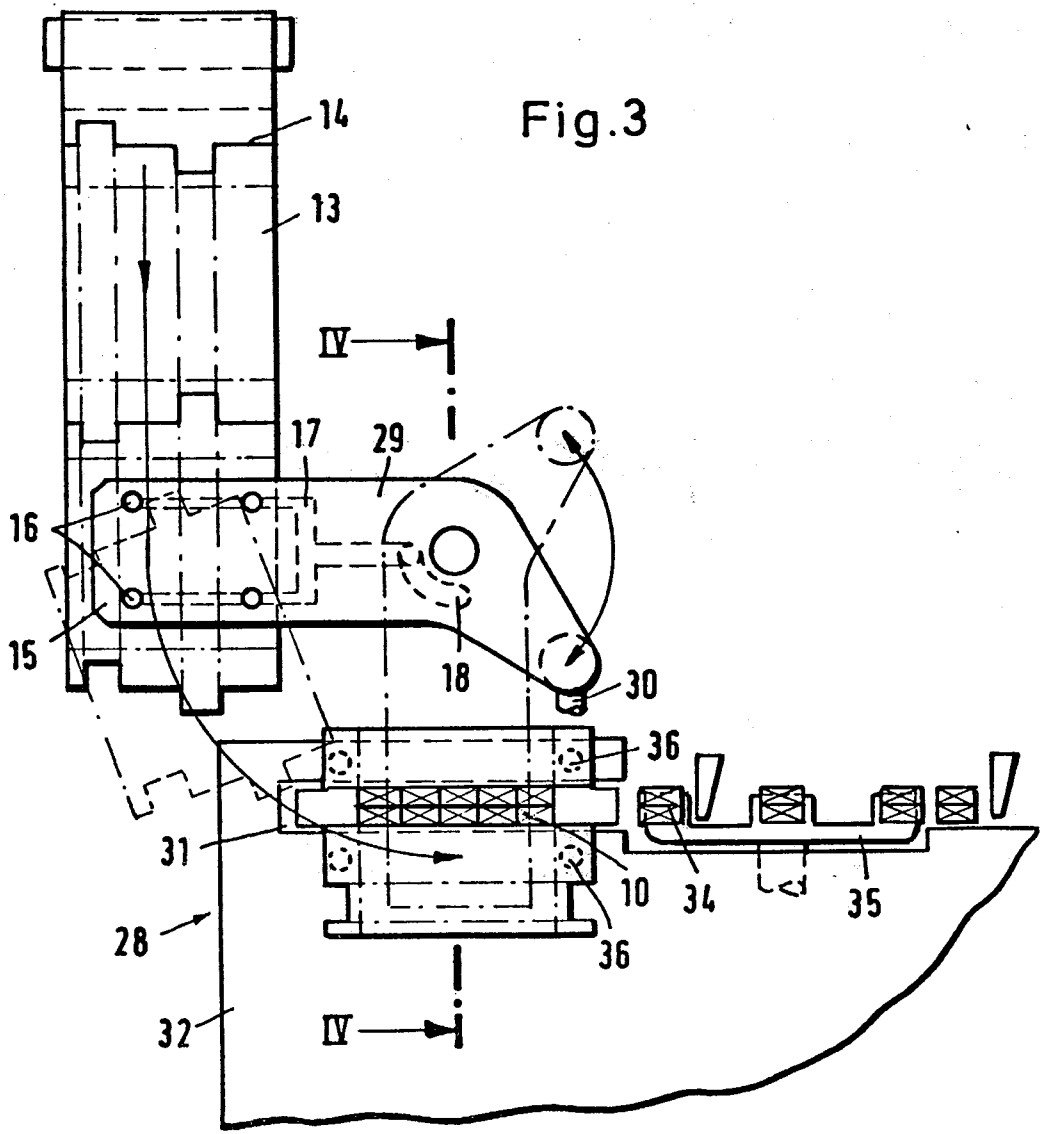
FIG. 3 is a corresponding view to that shown in FIG. 1 of a different embodiment of the apparatus.

In the embodiment shown in FIGS. 3–4, during the rotation of the separated blank 12 in the plane of the packs (about an angle of 90°) it is moved along one fourth of a circumferential path and thus supplied to an insertion station 28 which is separated from the cutting zone. Accordingly, in this case, the blank holder 15 is mounted on a reciprocating pivot arm 29. The pivot arm 29 can be operated by a push rod 30 driven in a suitable manner. In this case the blank holder 15 is again provided with a plurality of suction holders 16.

The blank 12, which is cut by suitable cutting blades not shown in detail in this case, is gripped by the blank holder 15—with the pivot arm 29 in the extended position represented—and by rotating the pivot arm 29 along a quarter circle, is supplied to the appropriately arranged insertion station 28. In this case, a mouthpiece, resp., its opening 31 is formed by a part of the stationary machine frame 32, or the like. The group of packs 10 is held ready on a conveyor 33 in front of this opening 31 and is then pushed by a slider 37, together with the blank 12, through the opening 31. The group of packs 10 is formed on this conveyor 33 by assembling two groups 34 which are ejected in succession from the compartments of a rotating turret 35.

The blank 12 is moved by the blank holder 15 in the region between the conveyor 33 and the machine frame 32 and is supplied to the latter. The frame 32, or mouthpiece formed by the same, is provided with suction holders 36 on both sides of the opening 31. These grip and hold the blank 12 which is carried and supplied by the blank holder 15.

The group of packs 10, together with the blank 12, are then pushed into the opening 31 in the above-described manner by a slider 37.

Figure 5:
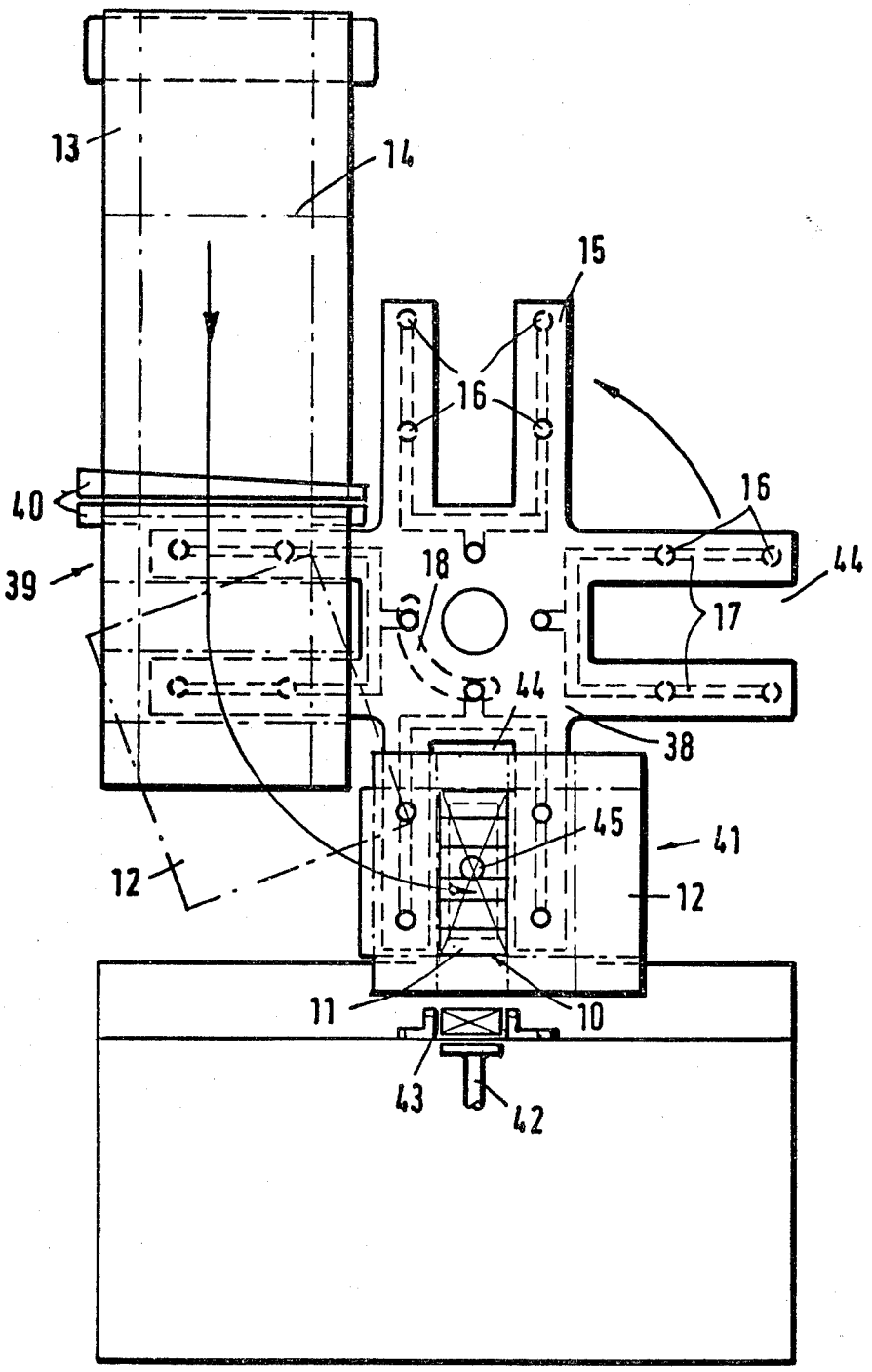
FIG. 5 is an essentially diagrammatic view according to FIGS. 1 and 3 of a third alternative.

In the apparatus shown in FIG. 5, a plurality, namely four blank holders 15, are mounted on a rotating support 38 in the manner of a turnstile. The suction holders are supplied successively to a reception station 39 in which the blanks 12 separated from the web 13 by the blade 40 are received. By rotating the blanks 12 in their plane they are then moved over one fourth of a circumferential path and supplied to an insertion station 41.

In deviation from the above embodiments, in this case the relative position is such that the group of packs 10 is formed with an upright longitudinal axis, i.e., with the cigarette packs 11 or the like disposed one on top of the other. Accordingly, the individual cigarette packs 11 are raised by a lifter 42 from a conveyor 43 and moved into position opposite an opening 44 in which they are to be inserted. The group of packs is engaged by a slider 45 in this region and pushed through the opening 44, taking with them the blank 12.

In this case, the (mouthpiece) opening 44 is formed directly by the blank holder 15, which is generally U-shaped and comprises suction holders 16 in the region of both arms. The blank 12 is thus held in readiness in front of this opening 44 by the suction holders 16 until the above-mentioned insertion operation.

What is claimed is:

1. In an apparatus for wrapping a stack (10) of a plurality of cigarette packs (11) in a carton blank (12) having a plurality of parallel fold lines, said blank being separable from an elongated web of material (13) having longitudinal axis fed to the apparatus in a vertical plane wherein the axis of said blank parallel to said fold lines is rotationally displaced from the longitudinal axis of said stack, the improvements characterized by:

(a) cutting means for severing a carton blank from said web, (b) a vertically oriented blank holder (15) mounted for rotation about a horizontal axis laterally displaced from said longitudinal axis of said web and including at least one blank engagement arm means extending radially outwardly from said horizontal axis, (c) a plurality of suction holders (16) disposed on said blank engagement arm means of said blank holder for retaining a severed carton blank thereon, and (d) means for rotating said blank engagement arm means and retained carton blank about said horizontal axis to rotate the retained blank to align in parallel relationship said axes of said blank and said stack, and to simultaneously convey said blank to a position adjacent said stack.

2. The apparatus as claimed in claim 1, wherein said blank engagement arm means is a pivot arm (29) displaceable through a quarter circle arc.

3. The apparatus as claimed in claim 1, wherein said blank holder comprise four in number and are mounted on a rotating support and wherein said apparatus further comprises a reception station and an insertion station for said blanks in rotative sequence and said rotating support rotates to present blanks sequentially to said reception station and the insertion station for reception of said cigarette packs.

4. The apparatus as claimed in claim 3, further comprising means for pushing groups of packs through an opening covered by the rotated blank such that the blank wraps in a U-shaped manner about the group of packs.

5. The apparatus as claimed in claim 1, wherein said apparatus further comprises a machine frame (32) defining a stationary mouthpiece opening (31), and suction holders (36) disposed on said frame for holding said blanks in front of the opening after said blanks are supplied by said blank holder to said stationary mouthpiece opening.

6. The apparatus as claimed in claim 1, wherein said blank holder forms a mouthpiece and is provided with an opening for the passage of a group of packs and the blank to effect wrapping of the packs by said blank.

7. The apparatus as claimed in claim 6, wherein said suction holders are disposed on at least both longitudinal sides of the opening of the blank holder mouthpiece for maintaining the separated blank overlying said mouthpiece.

* * * * *